US006200151B1

(12) United States Patent
Kaneko

(10) Patent No.: US 6,200,151 B1
(45) Date of Patent: Mar. 13, 2001

(54) LOWER SURFACE CONTACT TYPE CONTACT

(75) Inventor: Tetsuya Kaneko, Chiba-ken (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 09/400,859

(22) Filed: Sep. 21, 1999

(30) Foreign Application Priority Data

May 26, 1999 (JP) ..... 11-146909

(51) Int. Cl.[7] ..... H01R 13/28
(52) U.S. Cl. ..... 439/289; 439/826
(58) Field of Search ..... 439/289, 826, 439/286, 71, 74, 66, 79, 80

(56) References Cited

U.S. PATENT DOCUMENTS 3,697,926 * 10/1972 Krafthefer ..... 439/289
4,268,102 * 5/1981 Grabbe ..... 439/74
4,555,152 * 11/1985 Johnson et al. ..... 439/74
5,230,632 * 7/1993 Baumberger et al. ..... 439/66
5,980,323 * 11/1999 Bricaud et al. ..... 439/630

FOREIGN PATENT DOCUMENTS 8-213126 8/1996 (JP) .

* cited by examiner

*Primary Examiner*—Khiem Nguyen
*Assistant Examiner*—J. F. Duverne
(74) *Attorney, Agent, or Firm*—Wenderoth, Lind & Ponack, L.L.P.

(57) ABSTRACT

A lower surface contact type contact which is to be arranged in array on a connector body made of an insulative material, comprising an upwardly projecting contact portion on which a lower surface of an external contact of an electronic part is placed to press the upward projecting contact portion downward; a leftwardly expanding curved spring portion including a downward displacement component for allowing a downward displacement of the contact portion when the contact portion is pressed downward by the external contact and a rightward displacement component for causing a tendency for rightward displacement of said contact portion; and a support post implanted in the connector body and adapted to support the curved spring portion, the support post being displaced leftward when the contact portion is displaced downward, so as to offset the tendenct for rightward displacement.

4 Claims, 5 Drawing Sheets

LOWER SURFACE CONTACT TYPE CONTACT

BACKGROUND OF THE INVENTION

This invention relates to a lower surface contact type contact which is brought into contact, under pressure, with a lower surface of an external contact of a given electronic part as represented by a wiring board, an IC package, etc.

A typical lower surface contact type contact, as schematically shown in FIG. 7, includes an upwardly projecting contact portion 3 which is brought into contact, under pressure, with a lower surface of an external contact 2 of a given electronic part 1. In order to displace the contact portion 3 resiliently downward, the contact portion 3 is supported by a sidewardly expanding curved spring portion 4.

The external contact 2 of the electronic part 1 is placed on the contact portion 3 to press the contact portion 3 downward, so that the curved spring portion 4 is compressed and the contact portion 3 is displaced downward. The restoring force of the curved spring portion 4 causes the contact portion 3 to contact, under pressure, the lower surface of the external contact 2.

The curved spring portion 4 is displaced downward when it is pressed downward by the external contact 2. The curved spring portion 4 naturally includes a downward displacement component F1 and a rightward displacement component F2. Therefore, the curved spring portion 4 is actually moved in a combined direction F3 of the components F1 and F2.

This directly reflects on the movement of the contact portion 3. Specifically, the contact portion 3 moves slantwise downward in the combined direction F3 from a contact start point P1 with respect to the external contact 2 and reaches a contact terminal point P2. As a consequence, a rightward escape (a movement) amount W is inevitably produced between the contact start point P1 of the contact portion 3 and the contact terminal point P2.

This escape amount W causes the contact portion 3 to slide on the lower surface of the external contact 2. In the case where the width of the external contact 2 is small, it gives rise to a problem that the contact portion 3 escapes from the lower surface of the external contact 2. This problem becomes increasingly serious as the external contact is arranged at a smaller pitch. Therefore, a countermeasure is demanded.

The present invention has been accomplished in order to obviate the above problem.

SUMMARY OF THE INVENTION

It is, therefore, a general object of the present invention to provide a lower surface contact type contact capable of obviating the problem inherent in the conventional comparable device.

It is a specific object of the present invention to provide a lower surface contact type contact in which a contact portion is assuredly moved in a vertical direction as much as possible, thereby ensuring a reliable contact relation. Owing to this arrangement, the lower surface contact type contact according to the present invention can effectively cope with the requirement for arranging the external contact at a smaller pitch.

In order to achieve the above object, there is essentially provided a lower surface contact type contact which is to be arranged in array on a connector body made of an insulative material, comprising an upwardly projecting contact portion on which a lower surface of an external contact of an electronic part is placed to press the upward projecting contact portion downward; a leftwardly expanding curved spring portion including a downward displacement component for allowing a downward displacement of the contact portion when the contact portion is pressed downward by the external contact and a rightward displacement component for causing a tendency for rightward displacement of said contact portion; and a support post implanted in the connector body and adapted to support the curved spring portion, the support post being displaced leftward when the contact portion is displaced downward, so as to offset the tendency for rightward displacement.

The support post may be provided on a lower end thereof with a surface mounting terminal element projecting outward from the connector body.

A swing-preventive element may extend downward from a continuous portion between the contact portion and the curved spring portion, so that abutment between lower end of the swing-preventive element and the connector body prevents the contact portion from swinging or twisting.

Preferably, a left side surface of the contact portion is caused to contact, under pressure, with the connector body by resilient force of the curved spring portion.

A more complete application of the invention and many of the attendant advantages thereof will be readily obtained as the same becomes better understood by reference to the following detailed description when considered in connection with the accompanying drawings.

DETAILED DESCRIPTION OF THE PREFERRED EMBODIMENT

Figure 1:
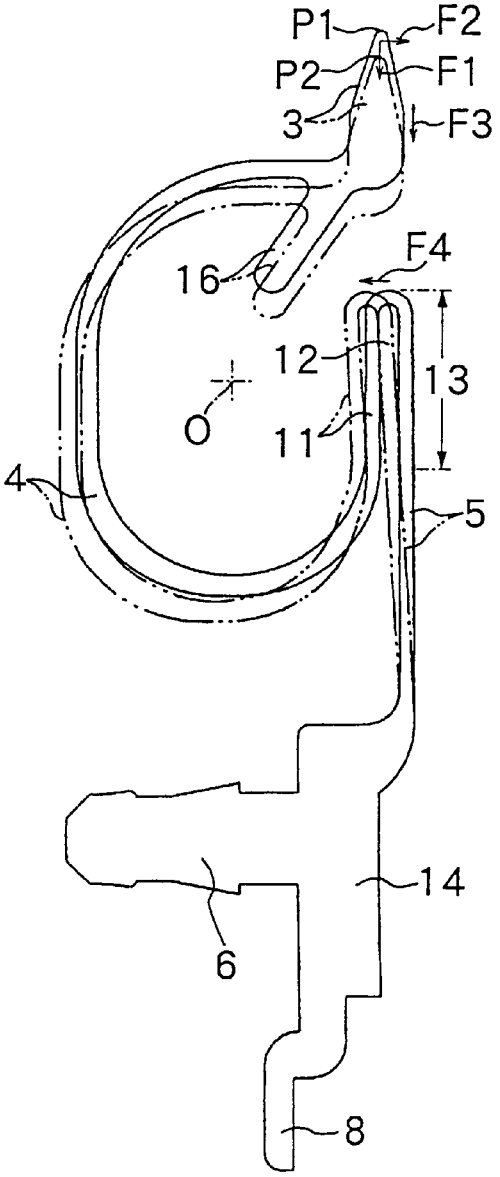
FIG. 1 is a front view of a lower surface contact type contact according to one embodiment of the present invention, in which motion of the lower surface contact type contact is indicated by a broken line.

FIGS. 1 through 6 show a lower surface contact type contact according to one preferred embodiment of the present invention.

This lower surface contact type contact includes an upwardly projecting contact portion 3 on which a lower surface of an external contact 2 of a given electronic part 1 is placed so as to press it downward. It further includes a leftwardly expanded curved spring portion 4. The contact portion 3 is supported by this curved spring portion 4. In other words, the contact portion 3 is continuous with one end of the curved spring portion 4.

The curved spring portion 4 includes a downward displacement component F1 for allowing a downward displacement of the contact portion 3 when it is pressed by the external contact 2, and a rightward displacement component F2 for allowing a rightward displacement of the contact portion 3.

The curved spring portion 4 is supported by a support post 5 which is displaced leftward when the contact portion 3 is displaced downward, such that the rightward displacement component F2 of the curved spring portion 4 is offset by the leftward displacement component F4 of the support post 5. Thus, the contact portion 3 is lowered generally vertically while maintaining its contacting position with respect to the external contact 2 at a contact start point P1.

That is, the contact portion 3 is continuous with one end of the curved spring portion 4, and the support post 5 for displacing the curved spring portion 4 leftward is continuous with the other end.

The support post 5 extends generally linearly in an up and down direction. The support post 5 is provided at a lower end portion thereof with a press-fit claw 6. The support post 5 is implanted in a connector body 7 through the press-fit claw 6. The support post 5 includes a surface mounting terminal element 8 extending downward from the implanting portion and projecting outward from a lower surface of the connector body 7.

For example, a rigid seat 14 is formed on a lower end of the support post 5 and the press-fit claw 6 projects leftward from a side surface of the seat 14. The press-fit claw 6 is press fitted in a press-fit hole 15 formed in a side surface of a bottom wall of a contact receiving space 9. By doing so, the whole lower surface contact type contact is supportingly implanted.

The support post and the curved spring portion 4 are received in the contact receiving space 9 formed on an upper part of the implanting portion. The contact portion 3 projects outward from an upper surface of the connector body 7 through an upper opening 10 of the contact receiving space 9 so as to be subjected to contact with the external contact 2 of the electronic part 1.

The curved spring portion 4 includes a connecting arm 11 extending generally linearly in an up and down direction along the continuous portion between the curved spring portion 4 and the support post 5. The curved spring portion 4 is continuous with an upper end of the support post 5 through the connecting arm 11.

The connecting arm 11 and the upper end extending portion of the support post 5 extend in parallel relation with a small space 12 therebetween, thereby forming an inverted U-shaped hairpin-like spring portion 13. This hairpin-like spring portion 13 projects upward beyond the center O of the curved spring portion 4. In other words, the upper end of the support post 5 extends in such a manner as to project upward beyond the center O. The space 12 facilitates the leftward displacement of the support post 5 and the leftward displacement of the curved spring portion 4.

A swing-preventive element 16 extends. downward from the continuous portion between the contact portion 3 and the curved spring portion 4 so that a lower end of the swing-preventive element 16 is brought into abutment with the connector body 7 (i.e., the inner wall surface of the contact receiving space 9). This arrangement serves to prevent the contact portion 3 from swinging or twisting. The longer the extending length dimension of the swing-preventive element 16 is, the greater the effect of swing prevention is. The swing-preventive element 16 and the contact portion 3 are in mutually oppositely directed relation and of a rigid structure.

Figure 3:
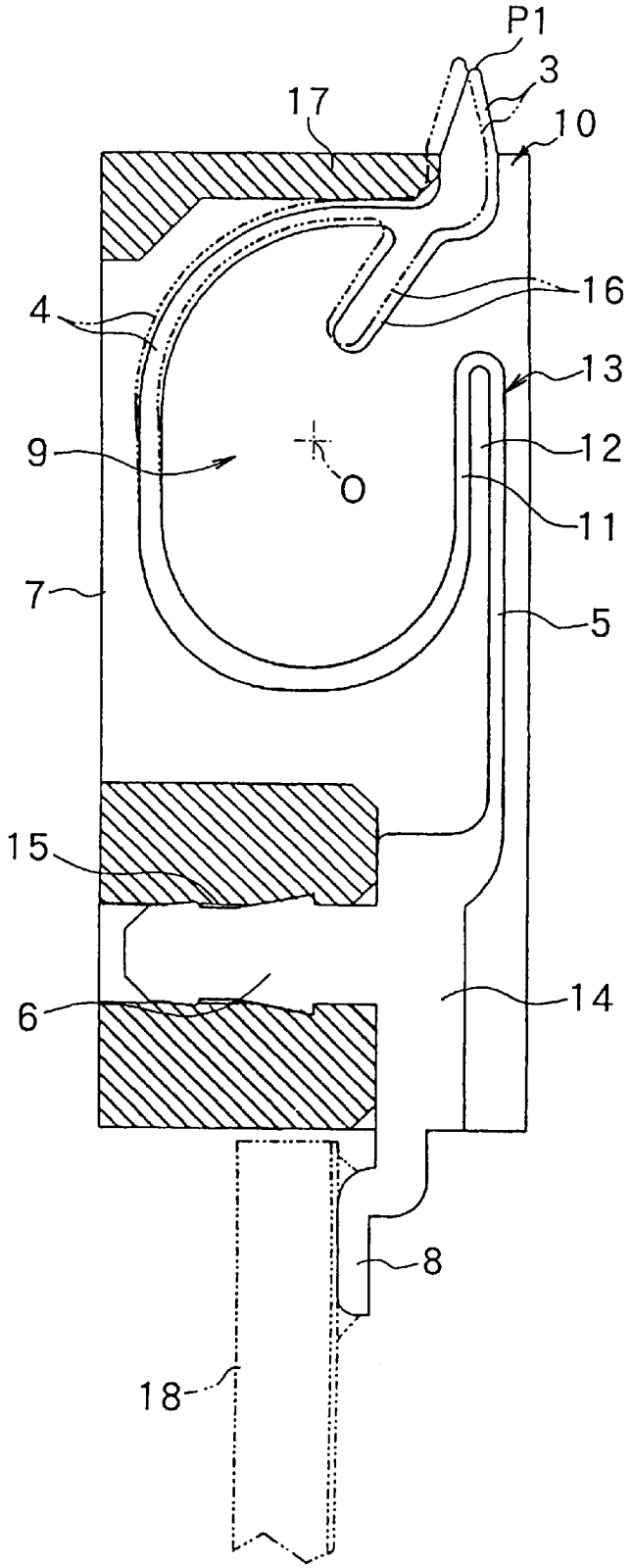
FIG. 3 is a sectional view of the above lower surface contact type contact implanted in a connector body.

As shown in FIG. 3, the left side surface of the contact portion 3 is caused to contact the connector body 7 by the resilient force of the curved spring portion 4. That is, the left side surface of the contact portion 3 is caused to contact an end face of a top wall 17 by the resilient force of the curved spring portion 4.

The position of the contact portion 3 indicated by a dotted line of FIG. 3 is a normal position before it is implanted (i.e., at the time of blanking operation). During the implanting operation, the contact portion 3 is displaced rightward against the resilient force of the curved spring portion 4 and the left side surface of the contact portion 3 is brought into contact, under pressure, with the end face of the top wall 17 by a restoring force of the curved spring portion 4.

Figure 2:
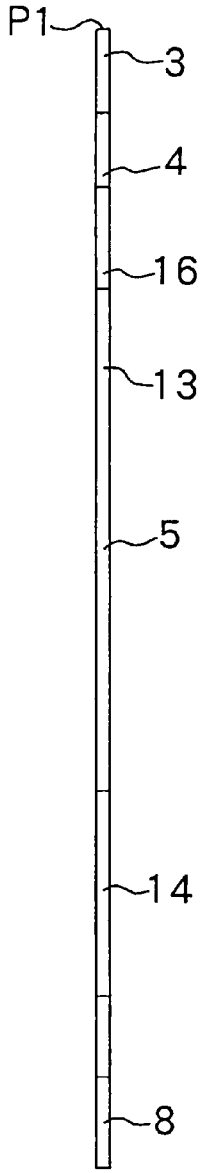
FIG. 2 is a right side view of the lower surface contact type contact of FIG. 1.

The whole lower surface contact type contact is formed by blanking a band plate so that it has the above construction and form. It is not necessary to subject the lower surface contact type contact to bending treatment. Accordingly, the obtained contact exhibits, as shown in FIG. 2, the form of a single plate when viewed in a direction of its right side. A front side surface of each contact element is present in a common plane and a rear side surface of each contact element is present in a common plane. Accordingly, both the front and rear side surfaces are present in mutually parallel common planes.

Figure 5:
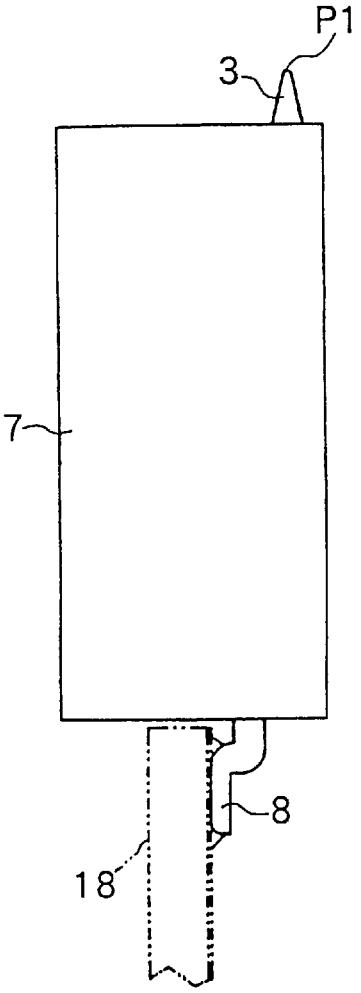
FIG. 5 is is a front view of a connector in which the above lower surface contact type contact is implanted.
Figure 6:
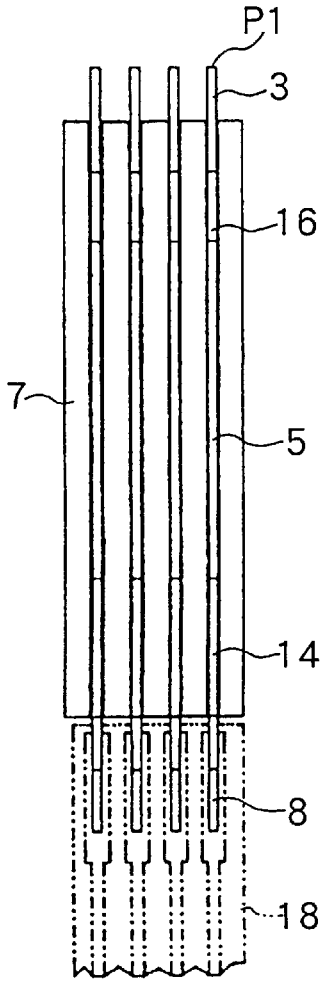
FIG. 6 is a right side view of FIG. 5.
Figure 7:
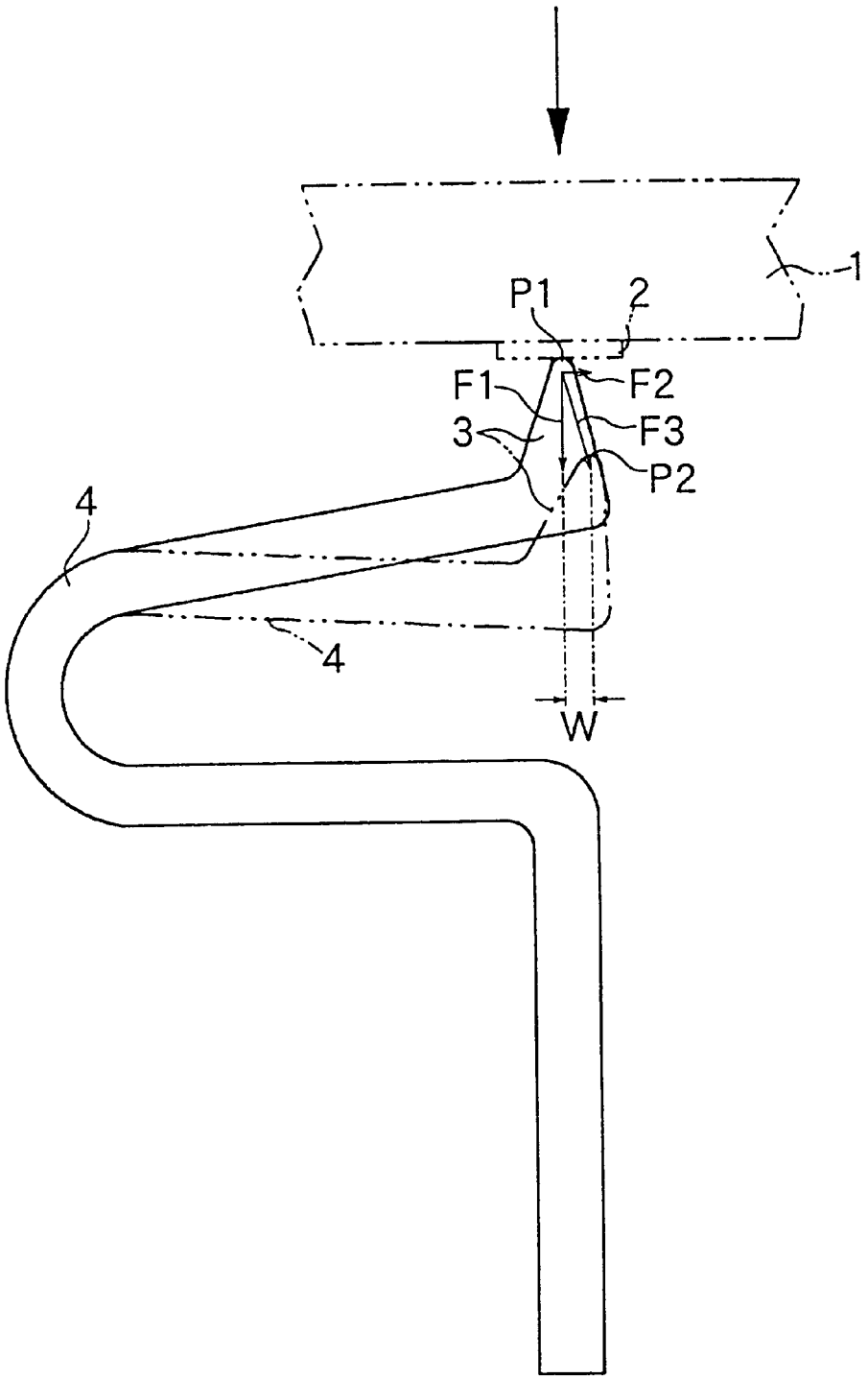
FIG. 7 PRIOR ART
FIG. 7 is a front view schematically showing the motion of a conventional lower surface contact type contact.

As shown in FIGS. 5 and 6, the connector body 7 includes a plurality of contact receiving spaces 9 arranged in array in a back and forth direction. The respective lower surface contact type contacts are arranged in array in the corresponding contact receiving spaces 9.

The surface mounting terminal element 8 of the lower surface contact type contact is attached, in superposed relation, to an electrode pad on the surface of a wiring board 18 by soldering paste or the like. By doing so, the lower surface contact type contact is connected to the wiring board 18.

With reference to FIGS. 4A–D, operation of the lower surface contact type contact will be described so that its construction will become more manifest.

Figure 4A:
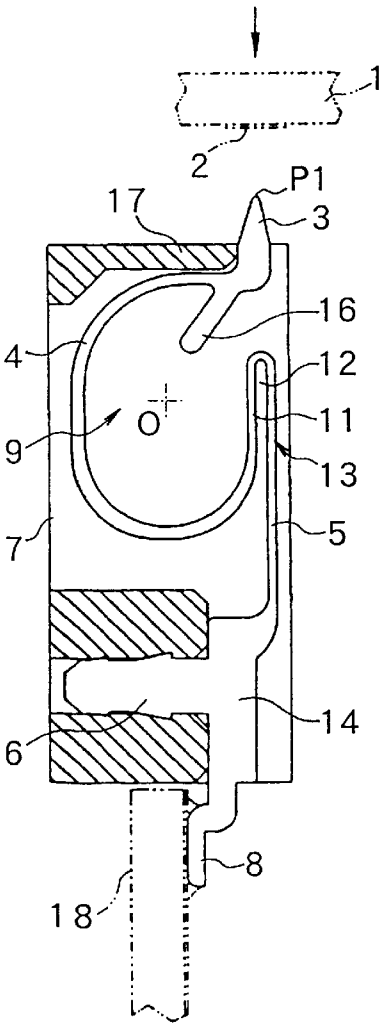
FIGS. 4A through 4D are sectional views showing the sequential steps of motion of the above lower surface contact type contact.
Figure 4B:
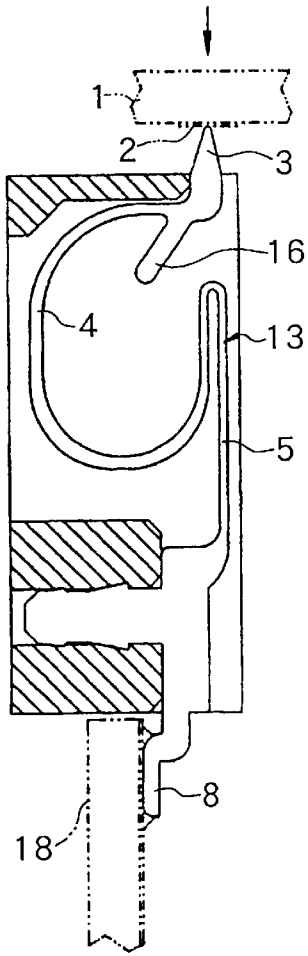

As shown in FIGS. 4A and 4B, the electronic part 1 such as a wiring board is placed on the contact portion 3 through a lower surface of the external contact 2.

Figure 4C:
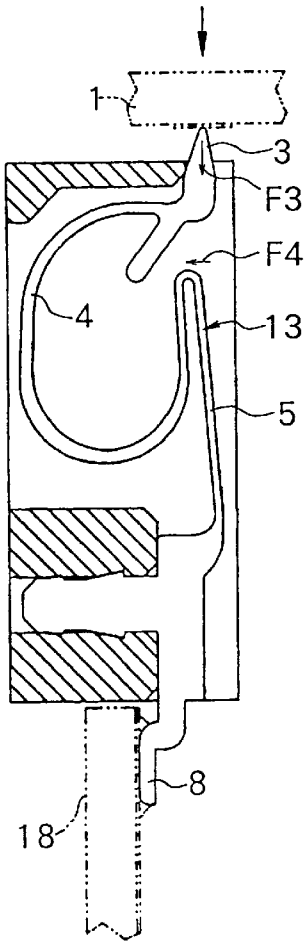
Figure 4D:
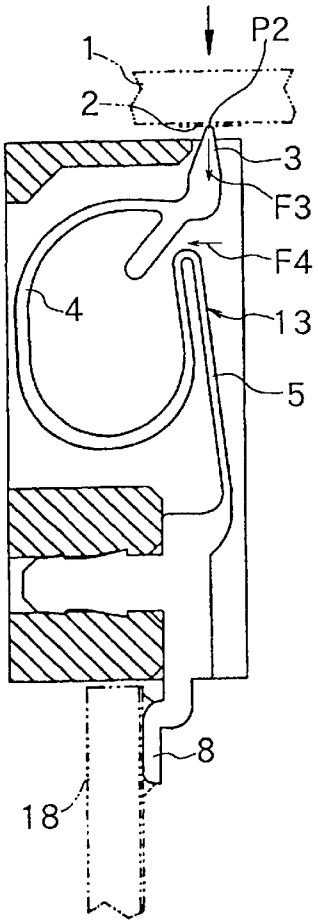

Then, as shown in FIGS. 4C and 4D, the electronic part 1 is pressed downward so that the contact portion 3 is pressed downward by the external contact 2. This downward pressing operation causes the curved spring portion 4 to be compressed and also causes the support post 5 (i.e., the hairpin-like spring portion 13) to be displaced leftward. This leftward displacement of the support post 5 causes the curved spring portion 4 to be displaced leftward together with the contact portion 3, thereby offsetting the rightward displacement component F2 of the curved spring portion 4.

As previously described, the curved spring portion 4 includes the downward displacement component F1 and the rightward displacement component F2 and is displaced slantwise downward by the combined compositions. As a consequence, an escape amount W is produced. The rightward displacement component F2, as a cause for producing the escape amount W, of the curved spring portion 4 is offset by the leftward displacement component F4 of the support post 5 and hairpin-like spring portion 13, so that the contact portion 3 is displaced vertically as much as possible.

Thus, the contact portion 3 and the external contact 2 are displaced downward generally vertically while maintaining their relative contact positions. That is, they reach the contact terminal point P2 while maintaining the contact start point P1.

The present invention can effectively obviate the problem inherent in the conventional lower surface contact type contact which problem (i.e., the escape amount W is produced to allow the contact portion to escape from the external contact) is created by the curved spring, thereby ensuring the contact portion to move generally vertically as much as possible. By doing so, a reliable contact relation is ensured. Therefore, the lower surface contact type contact according to the present invention can effectively cope with the requirement for arranging the external contact at a smaller pitch.

It is to be understood that the form of the invention herewith shown and described is to be taken as the preferred embodiment of the same, and that various changes in the shape, size and arrangement of parts may be resorted to without departing from the spirit of the invention or the scope of the appended claims.

What is claimed is:

1. A lower surface contact type contact which is to be arranged in array on a connector body made of an insulative material, comprising:

an upwardly projecting contact portion on which a lower surface of an external contact of an electronic part is placed to press said upward projecting contact portion downward;

a leftwardly expanding curved spring portion including a downward displacement component for allowing a downward displacement of said contact portion when said contact portion is pressed downward by said external contact and a rightward displacement component for causing a tendency for rightward displacement of said contact portion; and a support post implanted in said connector body and adapted to support said curved spring portion, said support post being displaced leftward when said contact portion is displaced downward, so as to offset said tendency for rightward displacement of said contact portion.

2. A lower surface contact type contact according to claim 1, wherein said support post is provided on a lower end thereof with a surface mounting terminal element projecting outward from said connector body.

3. A lower surface contact type contact according to claim 1, wherein a swing-preventive element extends downward from a continuous portion between said contact portion and said curved spring portion, so that abutment between a lower end of said swing-preventive element and said connector body prevents said contact portion from swinging or twisting.

4. A lower surface contact type contact according to claim 1, wherein a left side surface of said contact portion is caused to contact, under pressure, with said connector body by resilient force of said curved spring portion.

* * * * *